US005377880A

United States Patent [19]

Moretti

[11] Patent Number: 5,377,880

[45] Date of Patent: Jan. 3, 1995

[54] FLUID SUBSTANCE DISPENSER WITH DEFORMABLE HEAD

[75] Inventor: Remo Moretti, Cremona, Italy

[73] Assignee: Lumson S.r.l., Capergnanica-Cremona, Italy

[21] Appl. No.: 149,761

[22] Filed: Nov. 10, 1993

[30] Foreign Application Priority Data

Dec. 4, 1992 [IT] Italy ..... MI92 A 002790

[51] Int. Cl.[6] ..... B65D 37/00

[52] U.S. Cl. ..... 222/207; 222/387; 222/494

[58] Field of Search ..... 222/207, 212, 215, 386, 222/383, 494, 387

[56] References Cited

U.S. PATENT DOCUMENTS

| | | | |
|---|---|---|---|
| 2,356,874 | 8/1944 | Nageotte . | |
| 2,732,101 | 1/1956 | Sohn . | |
| 3,768,705 | 10/1973 | Spatz . | |
| 3,888,636 | 6/1975 | Sczerzenie et al. . | |
| 4,402,431 | 9/1983 | Wiegner et al. . | |
| 4,421,255 | 12/1983 | Czech . | |
| 4,696,415 | 9/1987 | Meshberg | 222/207 X |
| 4,792,065 | 12/1988 | Soehnlein et al. | 222/386 X |
| 4,809,887 | 3/1989 | Jupin et al. | 222/207 |
| 4,913,322 | 4/1990 | Stöffler et al. | 222/207 |
| 4,946,076 | 8/1990 | Hackmann et al. | 222/207 |
| 5,042,695 | 8/1991 | Battegazzore | 222/386 X |
| 5,125,539 | 6/1992 | Schneider | 222/207 X |

FOREIGN PATENT DOCUMENTS

| | | |
|---|---|---|
| 0013691 | 8/1980 | European Pat. Off. . |
| 0051790 | 5/1982 | European Pat. Off. . |
| 0084638 | 8/1983 | European Pat. Off. . |
| 0097972 | 1/1984 | European Pat. Off. . |

*Primary Examiner*—Gregory L. Huson

*Attorney, Agent, or Firm*—Oblon, Spivak, McClelland, Maier & Neustadt

[57] ABSTRACT

A fluid substance dispenser including a container defining an elongate chamber to contain the fluid substance. The container is closed at one end by a movable piston and at its other end by a transverse fixed wall from which there extends, outwards from the chamber, an elongate appendix the free end of which is positioned to correspond with a hole provided in a deformable cap defining with the fixed wall a compression chamber. The edge of the cap is elastically urged to seal against said end when the cap is in its rest state, whereas it separates partly from it when the cap is pressed to dispense the fluid substance.

3 Claims, 2 Drawing Sheets

FLUID SUBSTANCE DISPENSER WITH DEFORMABLE HEAD

BACKGROUND OF THE INVENTION

1. Field of the Invention

This invention relates to a dispenser for fluid substances, in particular creams or liquids, of the type comprising a container defining an elongate chamber to contain the substance and closed at one end by a piston movable along the chamber.

2. Discussion of the Background

A fluid substance dispenser is known provided with a single chamber containing the substance, which is compressed by elastically deforming a portion of the dispenser, in order to deliver it through a discharge nozzle. In these dispensers the piston movable within the chamber is provided with means which prevent it from retracting when the substance is put under pressure.

These means can consist of a toothed rod or the like extending through the entire container chamber from its head and passing through a hole provided in the piston.

At the hole there are provided elements which engage the rod to enable the piston to move only towards the container head.

Each time the dispenser is operated, the rod is lowered within the hole in the piston, which is then dragged by the rod towards the container head when the dispenser ceases operation to return elastically into its rest state (dispensers of this type are described for example in U.S. Pat. No. 2,732,101, U.S. Pat. No. 2,356,874 and U.S. Pat. No. 4,421,255).

In another type of dispenser with a single substance-containing chamber, radially projecting metal lugs are rigid with the piston and have their ends in contact with and pressing against the cylindrical wall of the containing chamber to enable the piston to move only in the direction towards the delivery nozzle. Whenever the dispenser is operated the piston is unable to retract during the compression of the substance, achieved by pressing a deformable part of the dispenser, because of the effect of the lugs.

When said pressing ceases and the first deformed part returns elastically to its rest position, a vacuum is generated in the chamber to cause the piston to rise within the chamber (dispensers of this type are described for example in EP 0051790, EP 0084638, U.S. Pat. No. 3,888,636 and U.S. Pat. No. 3,768,705).

These types of dispensers, comprising a single chamber acting simultaneously as the substance container and the compression chamber for the substance, have the drawback of being very costly (for example because of the provision of the toothed rod and the system for its engagement with the piston, and because of the provision of metal lugs rigid with the piston respectively), of being rather difficult to assemble, and requiring a rather large force for their operation.

To overcome the aforesaid drawbacks dispensers are known having two separate chambers communicating via a non-return valve. Of the two chambers, one is cylindrical and is intended only to contain the substance, it being closed at one end by a sealed piston freely slidable within the chamber.

The other chamber, which acts as the compression chamber, is at least partly deformable (to compress that part of its contained substance which has been drawn through the non-return valve by the vacuum in the collection chamber) and comprises a delivery nozzle provided with a shut-off valve to only allow the substance to pass to the outside.

When delivery ceases, the deformable part returns to its rest position to close the nozzle, and the wall of the cap in returning to its rest position generates a vacuum which draws the substance from the cylindrical chamber to the compression chamber through a non-return valve.

These types of dispenser (described for example in U.S. Pat. No. 4,402,431, EP-A-0097972 and EP-A-0013691) are much simpler than those heretofore described, but have the drawback that the delivery nozzle comprises an elastically closable non-return valve (which opens when the substance is compressed and closes elastically when delivery ceases).

This valve is inserted into a delivery nozzle in which a portion of relatively considerable length lies downstream of said valve.

The result is that if the dispenser is not used for a fairly lengthy period, the substance tends to harden within said nozzle and/or in contact with the discharge valve, to obstruct them or make operation and delivery extremely difficult.

In any event, the sealing of the non-return valve inserted into the nozzle is very problematical because this valve is in direct contact with the substance both upstream and downstream of the valve.

SUMMARY OF THE INVENTION

An object of the invention is to provide a dispenser of this latter type which is of extremely simple structure, easy operation and reliable action, has low production cost, is free from delivery ducts in which the substance can stagnate, and in particular has no valve positioned within said ducts.

This and further objects are attained by a fluid substance dispenser with a deformable head comprising a container defining an elongate chamber to contain the substance and closed at one end by a piston movable along, and provided with members sealing against, the timer cylindrical wall of the chamber, and closed at its other end by a transverse fixed wall comprising at least one passage at which there is provided a non-return valve arranged to allow the substance to emerge from the chamber, on the outside of said container and rigid therewith there being provided a deformable cap defining with said transverse fixed wall a compression chamber, there being provided a nozzle for discharging the substance from said compression chamber and a closure member for said nozzle, wherein from said transverse fixed wall there extends into said compression chamber at least one elongate appendix the free end of which is positioned at a hole provided in said deformable cap, the cap edge in correspondence with said hole being elastically urged to seal said free end when the cap is in its rest state, that portion of the cap corresponding with its hole plus the adjacent end portion of the appendix together forming said discharge nozzle and said nozzle closure member.

BRIEF DESCRIPTION OF THE DRAWINGS

For a better understanding of the invention one embodiment of the dispenser is shown by way of non-limiting example on the accompanying drawings, in which.

Figure 1:
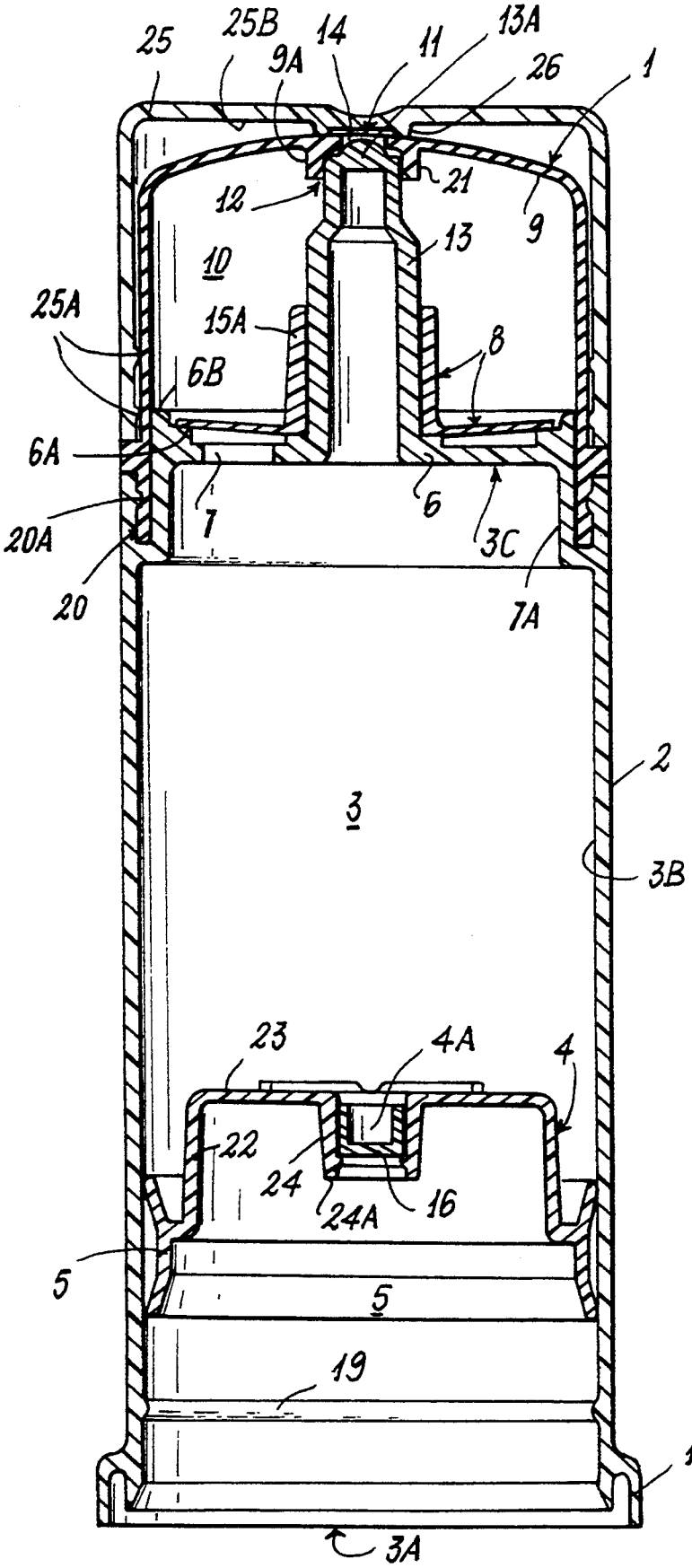
FIG. 1 is a section through a dispenser according to the invention in its rest state ready for use.

With reference to said figures, a substance dispenser according to the invention comprises a container 2 defining an elongate cylindrical chamber 3 for containing the substance and closed at one end 3A by a piston 4 and at its other end 3C by a transverse fixed wall 6 comprising a plurality of passages 7 (only one is visible in the figures) at which there is provided a non-return valve 8. On the outside of the container and rigid with it there is provided a deformable cap 9 which together with the transverse fixed wall 6 of the container defines a compression chamber 10. From said transverse fixed wall 6 there extends into the compression chamber 10 an elongate appendix 13 the free end 13A of which is positioned at a substance delivery hole 14 provided in the cap 9.

Specifically, the container 2 comprises at its end 3A a circular support base 18 and, internally, a circular rib 19 acting as a limit stop for the piston 4. At its upper end 3C the container comprises an annular slot 20 with an internal annular step 20A, to act as a seat for the cap 9, the lower edge of which rests in the slot and cooperates with the step 20A so that the cap is securely connected to and sealed against the container.

The annular slot 20 is defined by an end portion of the container wall 2 and a wall 7A opposing and inwards of this latter, and also acting as a connection between the wall 6 and the side wall of the container.

At the passages 7 the wall 6 comprises an annular step 6A extending towards the chamber 10 defined by tile cap 9.

The non-return valve 8 consists of a substantially tubular part 15A to be mounted about the appendix 13 and a discoidal part 15 extending from the lower edge of the tubular part.

The discoidal part 15 is flexible and its free edge is elastically pressed against the annular step 6A of the wall 6 so as to form a seal against said wall when the dispenser is in its rest state.

The discoidal part 15 rises from said step to hence connect together the chambers 3 and 10 when the substance is drawn into the chamber 10 from the chamber 3 (as explained hereinafter) after a certain quantity thereof has been dispensed.

The elongate appendix 13 extends centrally within the wall 6 and coaxial to the container 2. In the illustrated example the appendix is substantially cylindrical and comprises, connected to the wall 6, a lower part which is of greater diameter than the upper part.

The free end 13A of the appendix 13 has a half-dome extending centrally from the fiat circular base of the appendix so as to form at said end 13A a sort of rounded step.

The cap 9, of hollow cylindrical form, has a rounded free end and is provided centrally with a hole 14 coaxial with the container 2 and appendix 13. An annular projection 21 extends into the compression chamber 10 from the edge of the hole 14.

When in the rest position (FIG. 1) the annular projection 21 and the edge of the hole 14 in the cap are elastically urged against the end 13A of the appendix 13 so as to form a seal and prevent the substance present in the chamber 10 from emerging through the hole 14.

The piston 4 is provided with members 5 which seal against the inner cylindrical wall 3B of the chamber 3 and can move along this wall.

The seal members 5 consist of a circular wall which is concave towards the opposing wall 3B of the container. The wall 5 is shaped such that the wall edges are elastically urged against the container wall 3B to hence prevent the substance contained within the chamber 3 from escaping or prevent air entering the chamber 3.

Figure 3:
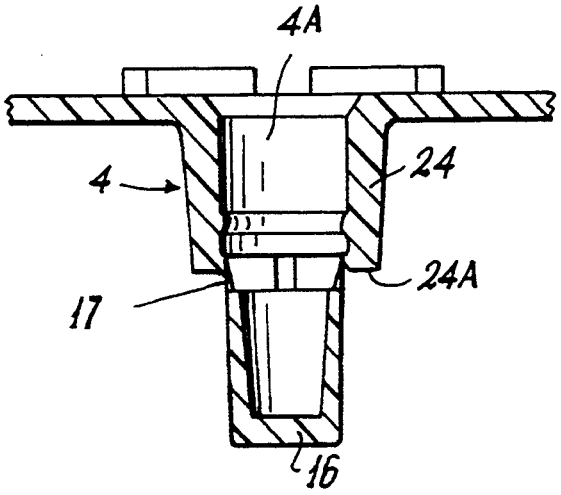
FIG. 3 is an enlarged view of a portion of the movable piston forming part of the dispenser's.

Above the sealing wall 5 the piston comprises a front wall 23 connected to the wall 5 by a wall 22. The wall 23 comprises a central hole 4A bounded by a boss 24 extending towards the container end 3A and sealable by a plug 16 which originally (as described hereinafter) is connected to the free edge 24A of the boss 24 (FIG. 3) by teeth 17 breakable by pressure exerted on the plug.

Finally, the dispenser comprises a cover 25 for the deformable cap 9.

At its free edge the cover 25 comprises internal projections 25A to retain the cover on the cap 9 when mounted on the cap.

On that flat face 25B of the free end of the cover 25 which faces the cap 9 there is provided a central annular projection 26 arranged to rest against the edge of the hole 14 in the cap 9 such that, when the cover is mounted on the cap, the edge of the hole 14 rests both against the end 13A of the appendix 13 and against said annular projection and is therefore unable to separate from the appendix for any reason, once the dispenser has been filled.

The dispenser of the invention is advantageously constructed of any known rigid plastics material by molding; only the non-return valve 8 and the cap 9 are constructed of rubber or of any known flexible plastics material.

Figure 2:
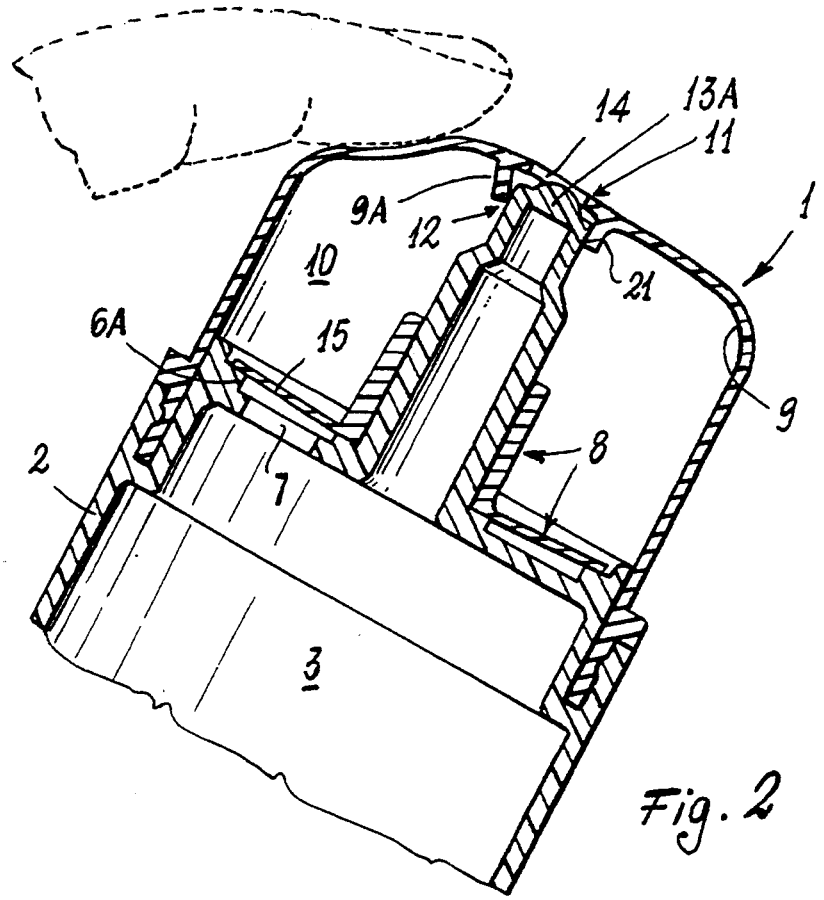
FIG. 2 is an enlarged sectional view of the head of the dispenser of FIG. 1, shown during substance delivery.

Assuming that the container 2 and compression chamber 10 have both been previously filled with a substance, ie that the dispenser is ready for use, the dispenser is operated in the following manner. After removing the cover 25 a portion of the deformable cap 9 is pressed (see FIG. 2); this increases the pressure within the compression chamber 10, to consequently separate a portion of the edge of the hole 14 in the cap 9 from the end 13A of the appendix, and create an aperture (FIG. 2) for the delivery of the substance; the substance contained within the chamber is unable to return to the container because of the presence of the valve 8, and hence flows outwards through said aperture.

When the cap 9 is no longer pressed the deformed wall of the cap returns elastically into its rest position (FIG. 1) and the edge of the hole 14 returns to sealedly adhere against the end of the appendix 13A.

Hence after a dispensing operation a vacuum is created in the chamber 10 relative to the container chamber 3, to draw the substance into the chamber 10 from the chamber 3 and open the non-return valve 8.

In this manner the compression chamber 10 is completely filled after each operation of the device and is hence immediately ready for further dispensing.

It should be noted that by virtue of the aforegoing the edge of the hole 14 in the cap and the free end 13A of the appendix 13 can be considered both as a delivery nozzle and as a closure member. The substance which has left the compression chamber 10 cannot stagnate either within the hole 14 or on the free end 13A of the appendix 13. In addition the mobility of the edge of the hole 14 relative to the end of the appendix 13 is better than in the case of the delivery and non-return valves of known dispensers in that in the latter the substance is present and remains present on both faces of these valves (both that facing the compression chamber and that facing outwards) present in the delivery nozzle.

The small number of components of the dispenser according to the invention facilitates and accelerates its assembly, which can be easily automated to lower production costs.

The dispenser is filled in the following manner.

The dispenser with the cap 9 fitted on the container 2 and the cover 25 mounted on the cap, but without the piston 4, is inverted relative to its normal position of use (ie relative to FIG. 1). A quantity of substance sufficient to fill the dispenser is poured into the chamber 3 via the end 3A of the container. In this initial filling stage the substance substantially does not penetrate into the compression chamber 10. The piston 4 is then inserted, with a usual member (not shown but conventional) acting on the center of the base of the piston to push it towards the cap 9 and compress the substance in the chamber 3, to also fill the chamber 10.

The piston is inserted very rapidly into the chamber 3 (the action on the piston is energetic) so that the air initially present in the chamber 10 is compressed into the cap.

The latter, by the action of the hence compressed air, becomes inflated to create a passage between the edge of the hole 14 and the end 13A of the appendix 13, so that the air can escape from the chamber 10 to tile outside by passing through the spaces existing between the cover 25 and the cap 9.

In this manner the chamber 10 can be filled, with substantially total elimination of the air contained in it.

Obviously, numerous modifications and variations of the present invention are possible in light of the above teachings. It is therefore to be understood that within the scope of the appended claims, the invention may be practiced otherwise than as specifically described herein.

The analogous problem of eliminating the air from the chamber 3 when the piston 4 is inserted is solved by virtue of the hole 4A provided in the base wall 23.

When the substance filling the chamber 3 offers excessive but predetermined resistance to the advancement of the piston 4, the teeth 17 connecting the plug 16 to the boss 24 (FIG. 3) are automatically broken, the teeth being dimensioned such as to withstand only a predetermined pressure force. The plug is hence urged (by the member acting on the plug 16 for mounting the piston in the chamber 3) into the boss 24, to close the hole 4A in the piston.

It should be noted that the plug 16, being advantageously initially connected to the piston by the breakable teeth 17, is automatically positioned in proximity to the hole 4A to be closed.

In a modification (not shown) to the described embodiment, flexible strips are provided extending from the outer edge 6B (FIG. 1) of the wall 6 and having rounded ends in contact with the inner wall of the cap 9, these strips being such as to facilitate the return of the cap 9 into its rest position after it has been pressed.

I claim:

1. A fluid substance dispenser with a deformable head comprising:

a container defining an elongate chamber for containing the fluid substance therein and having a piston movable along said chamber which closes a first end of the container, said piston including a sealing member contacting an inner cylindrical wall of the chamber, and a transverse fixed wall located in said container for closing a second end of the container, the fixed wall having at least one passage formed therein;

a non-return valve positioned in said at least one passage to allow the substance to be discharged from the chamber, wherein the valve extends outside of said container and is rigid therewith;

a deformable cap mounted on said container and defining with said transverse wall a compression chamber, said cap having a hole formed therein;

a nozzle formed by said hole in said cap for discharging the substance from said compression chamber and a closure member for closing said nozzle, wherein said closure member includes at least one elongate appendix which extends from said transverse fixed wall into said compression chamber, a free end of said appendix being positioned at the hole provided in said deformable cap, and wherein an edge of the cap corresponding with said hole is elastically urged to seal said free end of said appendix when the cap is in a rest state.

2. A dispenser as claimed in claim 1, wherein the transverse fixed wall has an edge and the non-return valve comprises a flexible disc having a central hole, said flexible disc being mounted about said appendix wherein when said fluid substance is under pressure, and said flexible disc being elastically urged against said edge of said transverse fixed wall to form a seal thereagainst when in the rest state.

3. A dispenser as claimed in claim 1, which comprises a plug connected by breakable teeth to the piston wherein the piston has a hole formed therein which is sealably closed by said plug.

* * * * *